US011801550B2

(12) United States Patent
Soloveykin

(10) Patent No.: US 11,801,550 B2
(45) Date of Patent: Oct. 31, 2023

(54) FEEDER SYSTEM

(71) Applicant: Foseco International Limited, Barlborough Links (GB)

(72) Inventor: Anton Viktorovich Soloveykin, Bashkortostan (RU)

(73) Assignee: FOSECO INTERNATIONAL LIMITED, Barlborough Links (GB)

( * ) Notice: Subject to any disclaimer, the term of this patent is extended or adjusted under 35 U.S.C. 154(b) by 0 days.

(21) Appl. No.: 17/213,689

(22) Filed: Mar. 26, 2021

(65) Prior Publication Data

US 2021/0299741 A1 Sep. 30, 2021

(30) Foreign Application Priority Data

Mar. 26, 2020 (RU) ..... 2020112271

(51) Int. Cl.
*B22C 9/08* (2006.01)

(52) U.S. Cl.
CPC ..... *B22C 9/088* (2013.01)

(58) Field of Classification Search
CPC ..... B22C 9/088; B22C 9/08
See application file for complete search history.

(56) References Cited

U.S. PATENT DOCUMENTS 3,815,665 A * 6/1974 Baur ..... B22D 7/10 164/359

FOREIGN PATENT DOCUMENTS

WO 2016/166497 A1 10/2016

OTHER PUBLICATIONS

Foseco Ferrous Foundryman's Handbook, edited by John R. Brown, Chapters 12 entitled "Sands and green sand" and Chapter 13 entitled "Resin bonded sand," 67 pages (2000).

* cited by examiner

*Primary Examiner* — Kevin P Kerns
*Assistant Examiner* — Steven S Ha
(74) *Attorney, Agent, or Firm* — Merchant & Gould P.C.

(57) ABSTRACT

The present invention relates to a feeder system for use in metal casting operations utilising casting moulds and to a feeder sleeve for use in the feeder system. There is provided a feeder system for metal casting, the feeder system comprising a feeder sleeve mounted on a breaker core, the feeder sleeve having a first end and an opposite second end, a longitudinal axis extending between the first and second ends, and a continuous sidewall extending generally around the longitudinal axis between the first and second ends, the sidewall defining a cavity for receiving molten metal during casting, and the breaker core defining an open bore therethrough for connecting the cavity to the casting, wherein the first end of the feeder sleeve is mounted on the breaker core, and the feeder sleeve comprises at least one protrusion extending from an exterior surface of the sidewall at the second end of the feeder sleeve.

13 Claims, 7 Drawing Sheets

Fig. 4(a)
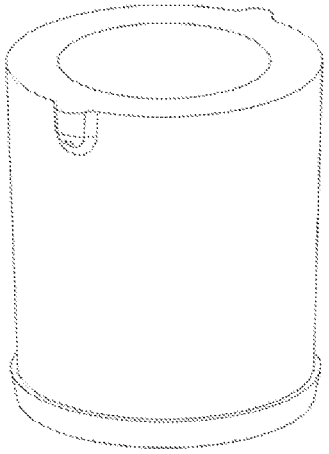
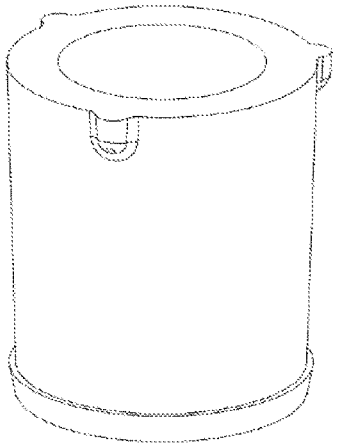
Fig. 4(b)
Fig. 4(c)
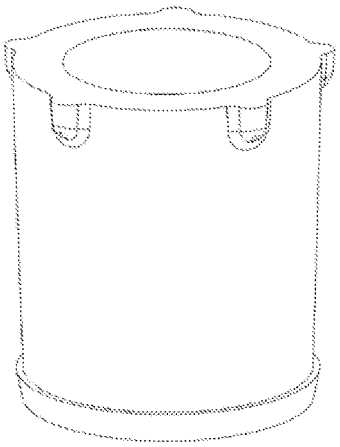
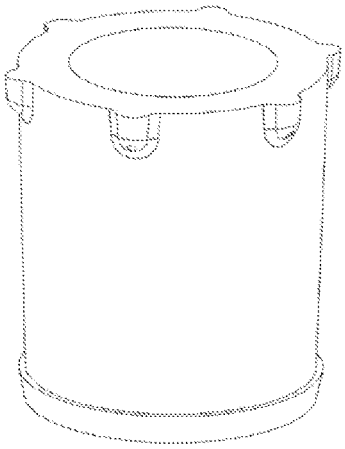
Fig. 4(d)
Fig. 4(e)
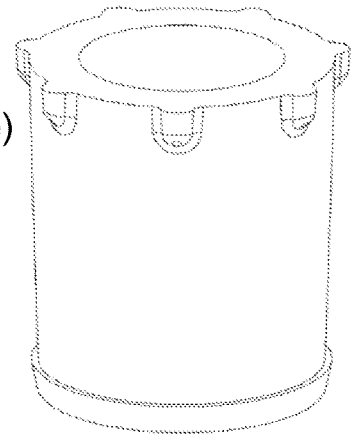
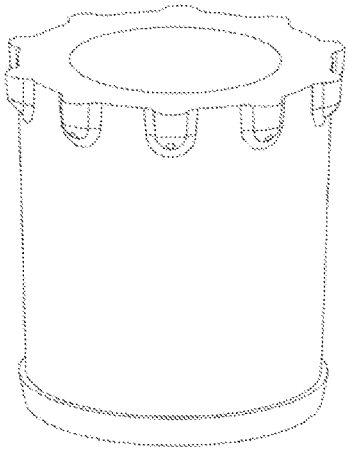
Fig. 4(f)

FEEDER SYSTEM

CROSS-REFERENCE TO RELATED APPLICATIONS

This application claims the benefit of priority to Russian Patent Application No. 2020112271, filed on Mar. 26, 2020, which application is incorporated herein by reference.

The present invention relates to a feeder system for use in metal casting operations utilising casting moulds and to a feeder sleeve for use in the feeder system.

BACKGROUND

In a typical casting process, molten metal is poured into a pre-formed mould cavity that defines the shape of the casting. However, the metal shrinks as it solidifies, resulting in shrinkage cavities which in turn result in unacceptable imperfections in the final casting. This is a well-known problem in the casting industry and is addressed by the use of feeder sleeves or risers which are integrated into the mould. Each feeder sleeve provides an additional (usually enclosed) volume or cavity which is in communication with the mould cavity, so that molten metal enters into the feeder sleeve from the mould cavity during casting. During solidification of the casting, molten metal within the feeder sleeve flows back into the mould cavity to compensate for the shrinkage of the casting.

Moulding practices are well known and are described for examples in chapters 12 and 13 of Foseco Ferrous Foundryman's Handbook (ISBN 075064284 X).

For large castings, foundry operators may need to walk over the top surface of the mould to carry out tasks such as applying a coating to the outside of the mould. Feeder sleeves may protrude above the mould material after formation of the mould. If a protruding feeder sleeve is accidentally stepped on by a foundry operator, the feeder sleeve may sink into the mould through the feeder recess and either protrude into the casting cavity or fall out of the feeder recess entirely and into the casting cavity. This may cause a serious defect in the casting, if the displacement of the feeder sleeve is not noticed before the molten metal is poured, or necessitate replacement of the mould, both of which are expensive and detrimental to productivity.

The present invention has been devised with these issues in mind.

SUMMARY

According to a first aspect of the present invention, there is provided a feeder system for metal casting, the feeder system comprising a feeder sleeve mounted on a breaker core. The feeder sleeve has a first end and an opposite second end, a longitudinal axis extending between the first and second ends, and a continuous sidewall extending generally around the longitudinal axis between the first and second ends. The sidewall defines a cavity for receiving molten metal during casting, and the breaker core defines an open bore therethrough for connecting the cavity to the casting. The first end of the feeder sleeve is mounted on the breaker core. The feeder sleeve comprises at least one protrusion extending from an exterior surface of the sidewall at the second end of the feeder sleeve.

DETAILED DESCRIPTION

In use, the breaker core will be in contact with the casting cavity. The breaker core on which the feeder sleeve is mounted may be of any type, including disc-shaped breaker cores made from resin-bonded sand or ceramic material, or collapsible metal breaker cores (for example, those described in Foseco PCT application no. WO 2016/166497). It will be understood that the first end of the feeder sleeve will be suitably configured for mounting on the chosen type of breaker core, and that the breaker core may be attached to the feeder sleeve by any appropriate method (e.g. adhesive, friction fit, locking mechanism, etc.)

During casting, the feeder sleeve will be orientated so that the first end (mounted to the breaker core) is at the bottom and the second end is at the top. If the feeder sleeve is accidentally stepped on after formation of the mould, the at least one protrusion at the top of the feeder sleeve (i.e. at the second end) abuts against the mould material surrounding the sidewall and thus resists downward movement, thereby preventing the feeder sleeve from sinking through the mould and falling into the casting cavity.

Preferably, the at least one protrusion extends from the exterior surface of the sidewall in a direction perpendicular to the longitudinal axis of the feeder sleeve.

In embodiments, the sidewall of the feeder sleeve is cylindrical. The cross-sectional shape of the cylinder may be generally circular, ovoid or oval-shaped. In embodiments, the diameter of the cylinder is generally constant from the first end to the second end.

Alternatively, the diameter at the first end of the feeder sleeve may be larger than the diameter at the second end, or vice versa. In embodiments, the sidewall of the feeder sleeve is generally cylindrical with a frustoconical portion located towards the first end of the feeder sleeve, which tapers towards the breaker core.

In embodiments, the top of the feeder sleeve (i.e. the second end) is open or comprises a bore therethrough. In such embodiments, molten metal might be poured directly into the casting cavity via the feeder, and the feeder system may contain a filter for filtering the molten metal before it enters the casting cavity. Preferably, the bore is centrally located. In alternative embodiments, the top of the feeder sleeve is closed.

In embodiments, the at least one protrusion is integrally formed with the sidewall. In such embodiments, the feeder sleeve (including the protrusion(s)) may be moulded using a one-shot moulding process. Alternatively or additionally, the at least one protrusion is a separate component which is attached to the feeder sleeve by any suitable means (e.g. adhesive, rivets, push-fit, etc.). In such embodiments, the protrusion may be made from the same material as the feeder sleeve (e.g. resin-bonded sand) or from a different material (e.g. metal or plastic).

In embodiments, the at least one protrusion extends outwardly from the sidewall (i.e. perpendicular to the longitudinal axis of the feeder sleeve) to a distance of at least 5%, 10%, 20% or 30% of the maximum diameter of the feeder sleeve. In embodiments, the at least one protrusion extends outwardly from the sidewall to a distance of no more than 35%, 30%, 25%, 20%, 15% or 10% of the maximum diameter of the feeder sleeve. In embodiments, the at least one protrusion extends outwardly to a distance of 5-35%, 5-20%% or 5-15% of the maximum diameter of the feeder sleeve. It will be understood that the maximum diameter of the feeder sleeve does not include the at least one protrusion and is measured at the second end of the feeder sleeve where the at least one protrusion is located, from the exterior surface of the sidewall on one side of the sleeve to the exterior surface of the sidewall on the opposite side of the sleeve.

In embodiments, the at least one protrusion extends from the second end of the feeder sleeve towards the first end along at least 4%, 5%, 10% 15% or 20% of the maximum height of the feeder sleeve (as measured in the direction of the longitudinal axis). In embodiments, the at least one protrusion extends from the second end of the feeder sleeve towards the first end along no more than 25%, 20%, 15%, 10% or 5% of the maximum height of the feeder sleeve. Preferably, the at least one protrusion extends from the second end towards the first end along 4-25%, 4-15% or 5-10% of the maximum height of the feeder sleeve. It will be understood that the maximum height of the feeder sleeve is measured from the second end of the feeder sleeve to the first end of the feeder sleeve without including the breaker core.

The at least one protrusion may take the form of a plurality of discrete protrusions spaced apart around the periphery of the second end of the feeder sleeve.

Alternatively, the at least one protrusion may take the form of an annular collar or rim which extends around the entire periphery of the second end of the feeder sleeve. It will be understood that any of the abovementioned embodiments may be freely combined with either the plurality of discrete protrusions or the annular collar/rim.

In embodiments where the at least one protrusion is a plurality of discrete, spaced apart protrusions, the at least one protrusion may comprise at least 2, 3, 4, 5, 6, 7, 8, 9 or 10 spaced apart protrusions. In embodiments, the at least one protrusion comprises between 2 and 10 spaced apart protrusions. Preferably, the at least one protrusion comprises 3 or 4 spaced apart protrusions. Providing more than 4 spaced apart protrusions increases the resistance of the feeder sleeve to downward movement, by increasing the area which abuts against the mould material, but reduces the number of sleeves which can be manufactured by one-shot moulding within a given time frame.

Providing 3 or 4 spaced apart protrusions gives an optimal balance between adequate resistance to downward movement and good manufacturing productivity.

In some embodiments, each of the spaced apart protrusions extends around no more than 5%, 10%, 15%, 20% or 25% of the circumference of the second end of the feeder sleeve. In some embodiments, each of the spaced apart protrusions extends around at least 3%, 5%, 10%, 15% or 20% of the circumference of the second end of the feeder sleeve. Preferably, each of the spaced apart protrusions extends around 3-25%, 3-20% or 5-15% of the circumference of the second end of the feeder sleeve.

In some embodiments, the spaced apart protrusions are evenly distributed around the periphery of the second end of the feeder sleeve, such that there is an equal distance between the centres of each of the protrusions. For example, the distance between the centres of the protrusions may be at least 5%, 10%, 20%, 30%, 40% or 50% of the circumference of the rim, or no more than 50%, 40%, 30%, 20%, 10% or 5% of the circumference of the rim. In other embodiments, the spaced apart protrusions are unevenly distributed around the periphery of the second end of the feeder sleeve, such that some of the protrusions are closer together and some of the protrusions are further apart. Preferably, the protrusions are distributed around the periphery of the second end in a symmetrical arrangement, with at least one plane of symmetry.

In embodiments, the spaced apart protrusions have a cross-section which is semi-circular, quarter-circular, wedge-shaped or square-shaped. In embodiments where the cross-sectional shape is semi-circular or quarter-circular, the protrusions may be semi-spherical or quarter-spherical. Preferably, each of the protrusions has the same cross-sectional shape and the same dimensions. In embodiments, the protrusions may be a continuous series of discrete protrusions forming, for example, a scalloped arrangement.

Preferably, each of the spaced apart protrusions has the same shape and dimensions. However, in some embodiments, the protrusions may vary in shape or dimensions.

In embodiments where the at least one protrusion is an annular collar or rim, the rim may extend continuously around the periphery of the second end, or may comprise one or more breaks. In embodiments, the annular rim is circular. In other embodiments, the annular rim is in the shape of a polygon having at least three sides, when viewed in plan view along the longitudinal axis of the feeder sleeve. The polygon may have at least 3, 4, 5, 6, 7, 8, 9 or 10 sides. In embodiments, the polygon has between 3 and 10 sides. The corners of the polygonal rim may effectively act as spaced apart protrusions. Preferably, the polygon has four sides and the rim is generally square.

In embodiments, the corners of the polygon are rounded. The radius of curvature of the rounded corners may be equal to the maximum distance to which the corners of the polygon project outwardly from the exterior surface of the sidewall. In embodiments, the radius of the rounded corners may be at least 10%, 25%, 50%, 75%, 90% or 100%, or no more than 90%, 75%, 50%, 25% or 10% of the maximum distance to which the corners of the polygon project outwardly from the exterior surface of the sidewall. In embodiments, the radius of curvature of the rounded corners is 10-100%, 25-100% or 50-100% of the maximum distance to which the corners of the polygon project outwardly from the exterior surface of the sidewall. The side edges of the rim may be squared off or rounded.

It will be appreciated that, in embodiments where the annular rim is in the shape of a polygon, the corners of the polygon will project outwardly from the exterior surface of the sidewall to a greater distance than the sides of the polygon.

In a particular embodiment, the sidewall is cylindrical (having a generally circular cross-section and a generally constant diameter from the first end to the second end of the feeder sleeve), and the at least one protrusion is a square rim. The corners of the square rim may be rounded. As such, the rim may not necessarily have four 90° corners, but may still be described as being square on the basis that it has four edges of equal length oriented at 90° to adjoining sides.

The invention also resides in a feeder sleeve for use in the feeder system according to embodiments of the first aspect.

According to a second aspect of the present invention, there is provided a feeder sleeve for use in metal casting, the feeder sleeve comprising a first end and an opposite second end, a longitudinal axis extending between the first and second ends, and a continuous sidewall extending generally around the longitudinal axis between the first and second ends, the sidewall defining a cavity for receiving molten metal during casting, the first end of the feeder sleeve being configured for mounting on a breaker core, and the feeder sleeve comprising at least one protrusion extending perpendicularly to the longitudinal axis from an exterior surface of the sidewall at the second end of the feeder sleeve.

The comments above in relation to the first aspect also apply to the second aspect.

BRIEF DESCRIPTION OF THE DRAWINGS

Embodiments of the invention will now be described by way of example only with reference to the accompanying drawings in which:

FIGS. 4(*a*) to 4(*f*) show schematic views of a number of variations of the embodiment shown in FIGS. 1 and 2;

DETAILED DESCRIPTION OF THE PREFERRED EMBODIMENTS

Figure 1:
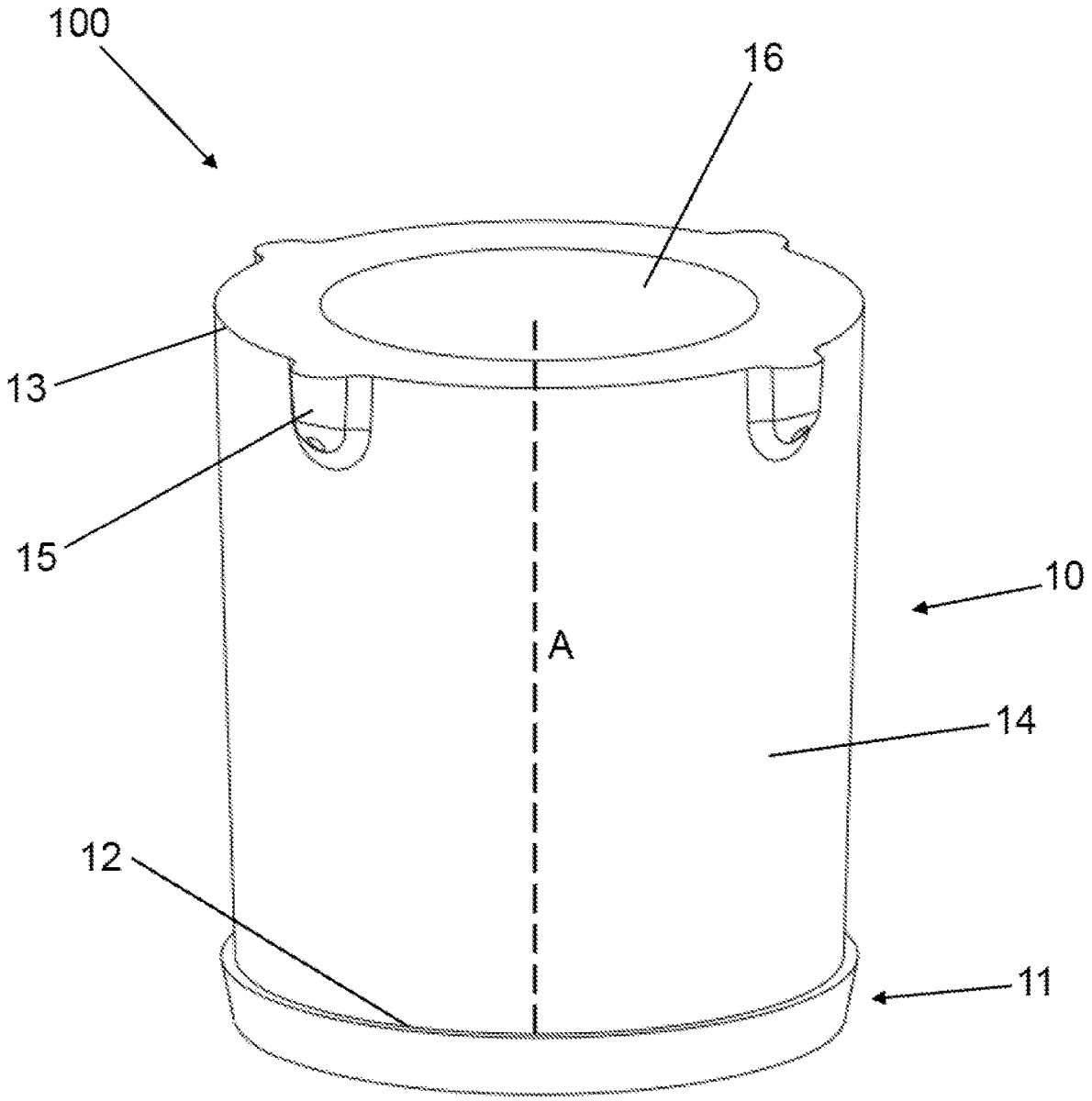
FIGS. 1 and 2 are schematic views of a feeder system according to an embodiment of the present invention.

Referring to FIG. 1, there is shown a feeder system 100 comprising a feeder sleeve 10 mounted on a breaker core 11. The feeder sleeve 10 has a first end 12 and an opposite second end 13, with a longitudinal axis A extending between the first and second ends 12, 13. A continuous sidewall 14 extends generally around the longitudinal axis A in the shape of a cylinder, defining a cavity therein for receiving molten metal. The first end 12 of the feeder sleeve 10 is mounted on the breaker core 11. The breaker core 11 is a conventional disc-type core defining an open bore therethrough (not shown) for connecting the feeder sleeve cavity to the casting.

Figure 2:
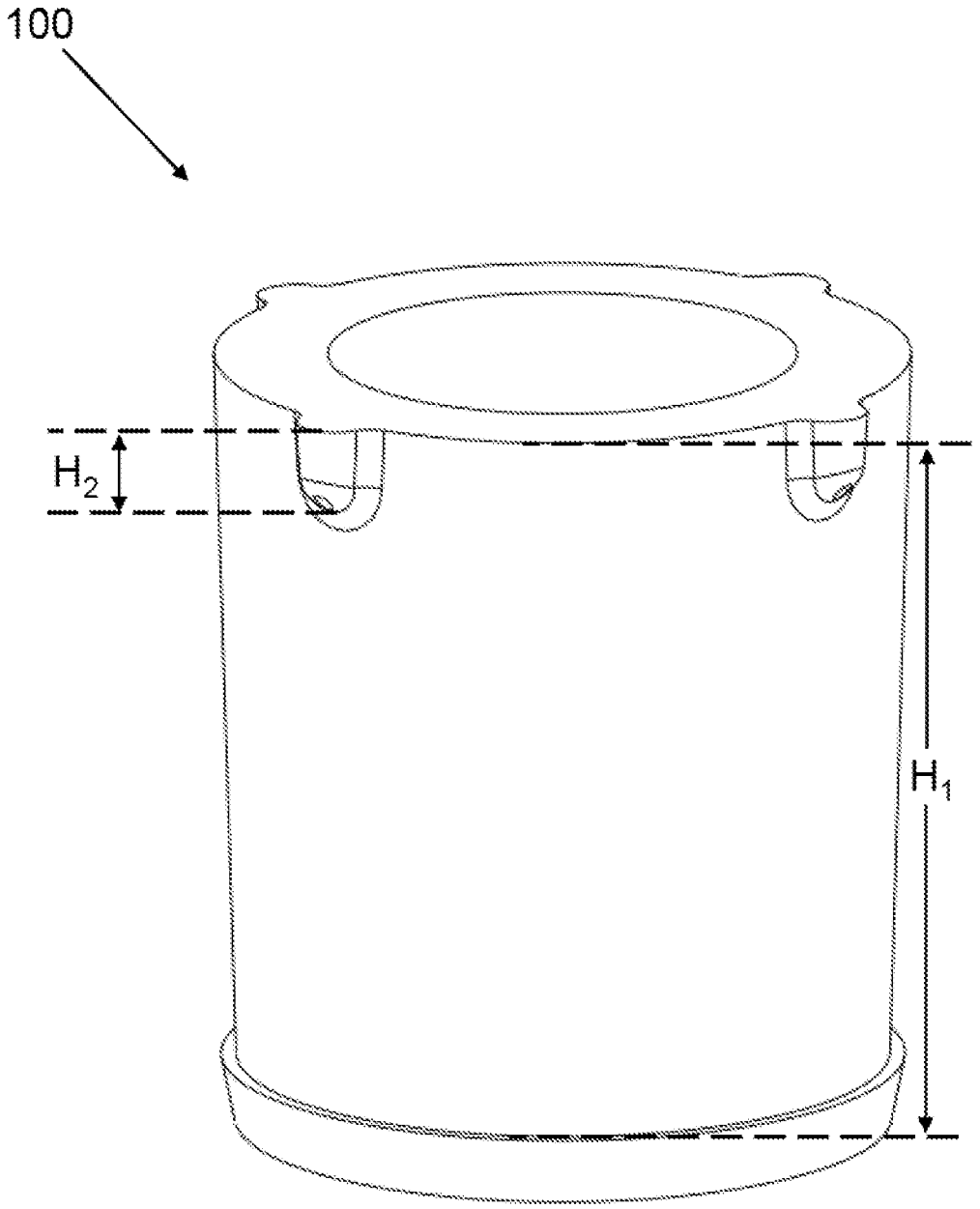
Figure 3:
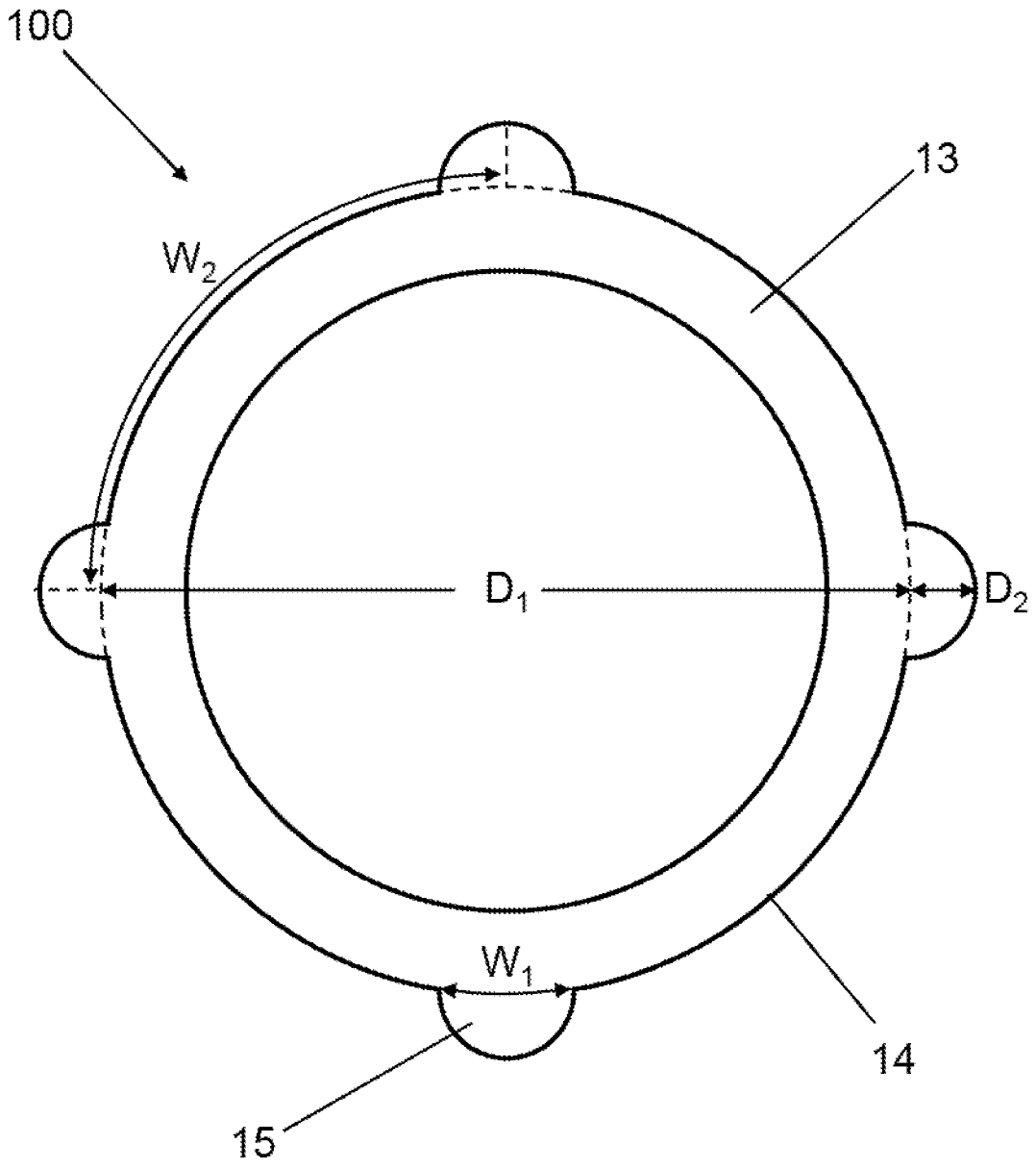
FIG. 3 is a plan view of the feeder system shown in FIGS. 1 and 2.

In the depicted embodiment, the feeder sleeve 10 comprises four discrete protrusions 15 extending outwardly from an exterior surface of the sidewall 14 at the second end 13 of the feeder sleeve 10. As shown in FIG. 2, the height $H_2$ of each protrusion is 10% of the maximum height $H_1$ of the feeder sleeve 10 (as measured in the direction of the longitudinal axis A). As shown in FIG. 3, the cross-sectional shape of each protrusion (as seen in plan view along the longitudinal axis A) is a semi-circle. The top edge of each protrusion 15 is flat and contiguous with the second end 13 of the feeder sleeve 10, while the bottom of each protrusion 15 is rounded. Each protrusion 15 extends from the exterior surface of the sidewall 14 to a distance $D_2$ which is 8% of the maximum diameter $D_1$ of the cylindrical sidewall 14. Each protrusion 15 extends around the periphery of the sidewall to a width $W_1$ that is 5% of the circumference of the cylindrical sidewall 14. The protrusions 15 are evenly spaced around the circumference of the sidewall 14, with a width $W_2$ between adjacent protrusions which is 20% of the circumference of the sidewall 14. In total, the coverage of protrusions 15 around the circumference of the sidewall 14 is 20%, with 80% of the circumference having no protrusions.

As shown in FIGS. 4(*a*) to (*f*), the feeder sleeve 10 does not need to comprise four discrete protrusions 15 and may comprise any suitable amount, such as 2, 3, 5, 6, 7, 8, 9 or 10 protrusions 15.

Figure 5:
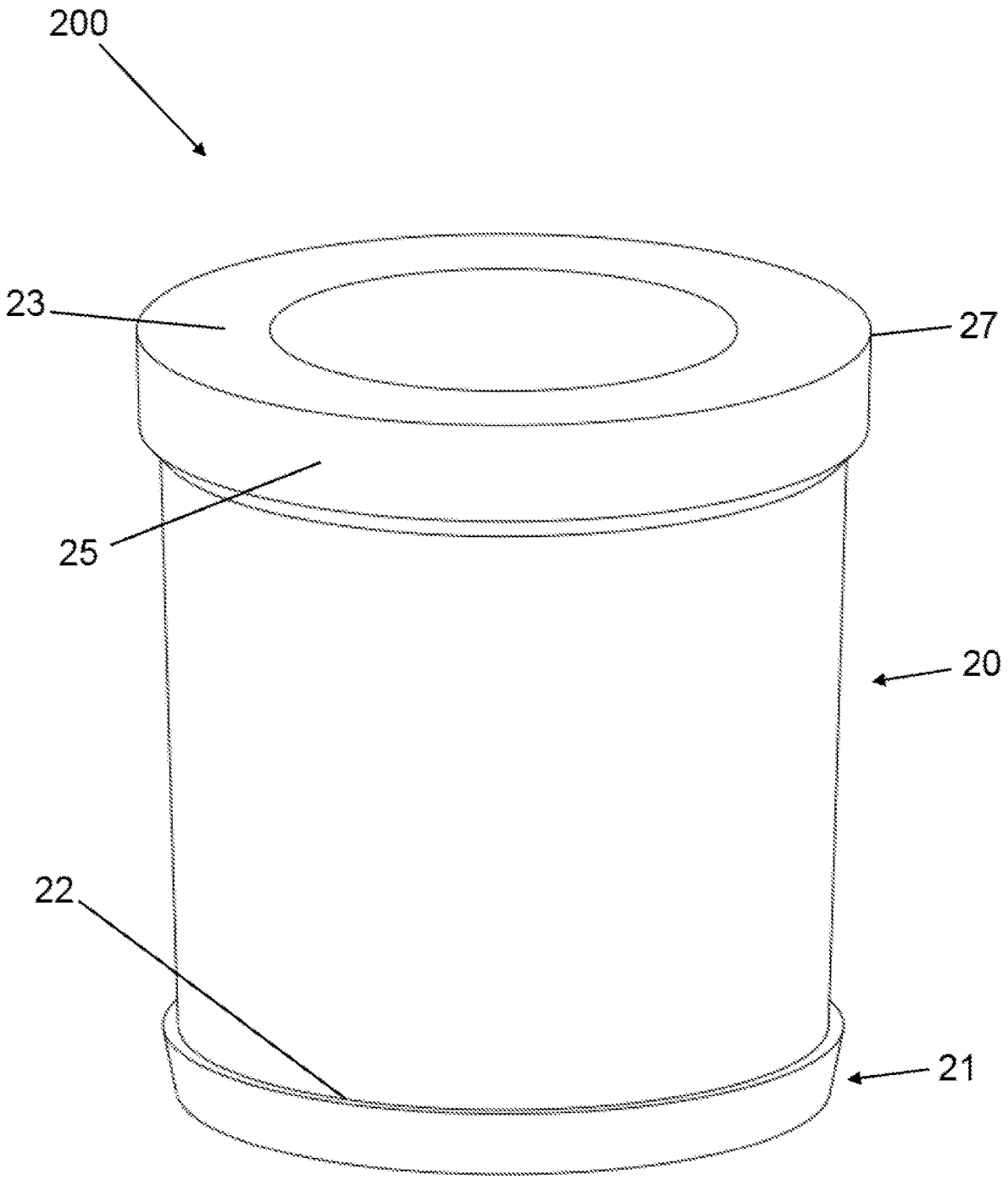
FIG. 5 is a schematic view of a feeder system in accordance with another embodiment of the present invention.

Referring to FIG. 5, there is shown another embodiment of a feeder system 200, comprising a feeder sleeve 20 mounted on a breaker core 21. The feeder system 200 is largely the same as the feeder system 100 shown in FIG. 1, except that the at least one protrusion is in the form of a circular rim 25 which extends around the entire periphery of the second end 23 of the feeder sleeve 20. The side edge 27 of the rim 25 is squared off rather than rounded.

Figure 6:
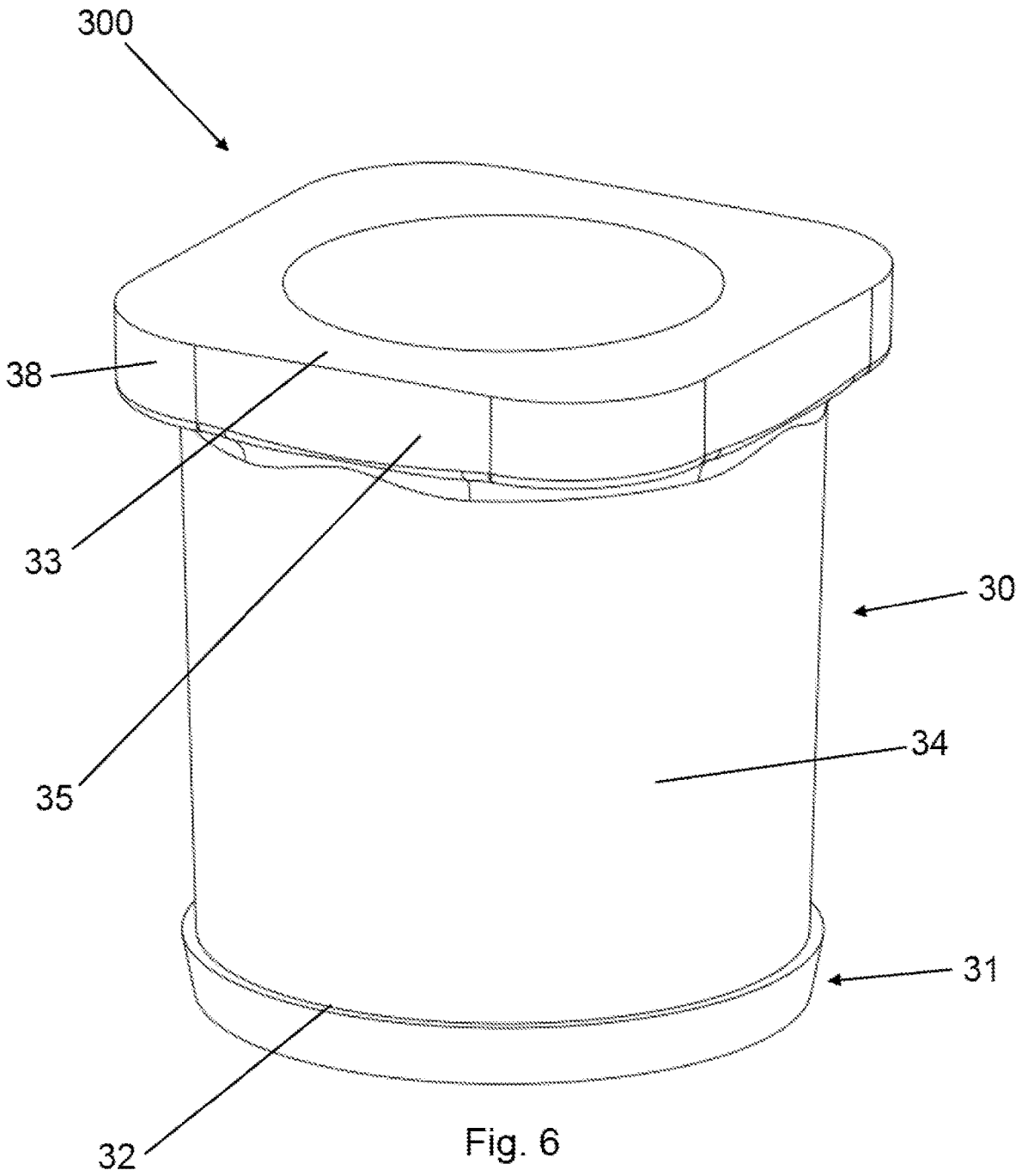
FIG. 6 is a schematic view of a feeder system in accordance with a further embodiment of the present invention.
Figure 7:
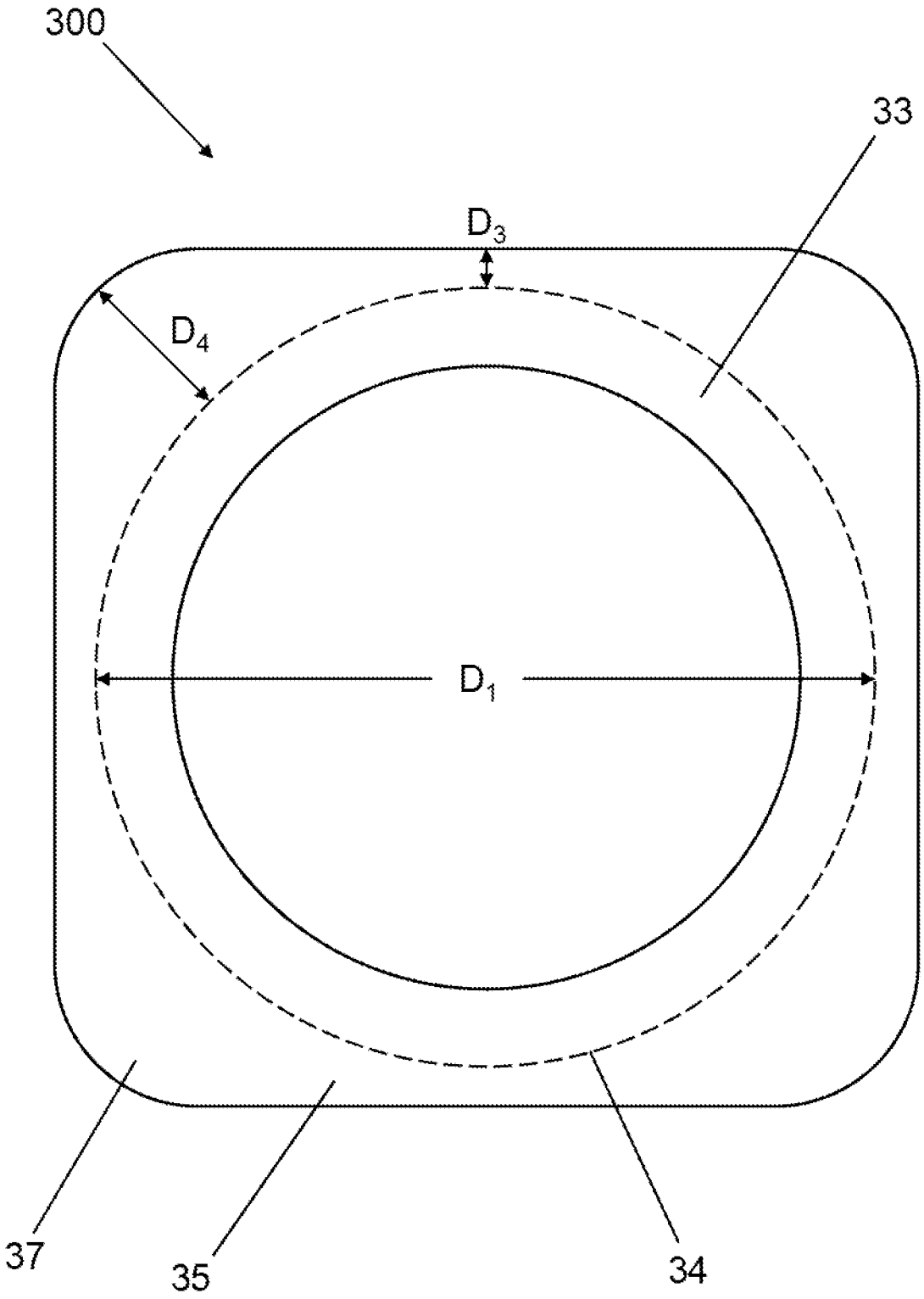
FIG. 7 is a plan view of the feeder system shown in FIG. 6.

Referring to FIG. 6, there is shown a further embodiment of a feeder system 300, wherein the at least one protrusion is in the form of a square rim 35. The corners 38 of the square rim 35 are rounded. As shown in FIG. 7, the square rim 35 projects from the exterior surface of the sidewall 34 to a minimum distance $D_3$ at the centre of the sides of the square and a maximum distance $D_4$ at the corners of the square. $D_3$ is 10% of the maximum diameter $D_1$ of the sidewall 34 and $D_4$ is 35% of the maximum diameter $D_1$ of the sidewall 34. The distance $D_4$ between the sidewall 34 and the corners 38 corresponds to the radius of curvature of the rounded corners.

The invention claimed is:

1. A feeder system for metal casting, the feeder system comprising a feeder sleeve mounted on a breaker core, the feeder sleeve having a first end and an opposite second end, a longitudinal axis extending between the first and second ends, and a continuous sidewall extending generally around the longitudinal axis between the first and second ends, the sidewall defining a cavity for receiving molten metal during casting, and the breaker core defining an open bore therethrough for connecting the cavity to the casting, wherein the first end of the feeder sleeve is mounted on the breaker core, and the feeder sleeve comprises a plurality of discrete protrusions extending from an exterior surface of the sidewall at the second end of the feeder sleeve, and wherein the protrusions extend outwardly from the sidewall to a distance of 5-35% of the maximum diameter of the sidewall at the second end of the feeder sleeve, and wherein the thickness of the sidewall at the second end of the feeder sleeve is greater than the radial extension of the protrusions.

2. The feeder system of claim 1, wherein the protrusions extend in a direction perpendicular to the longitudinal axis of the feeder sleeve.

3. The feeder system of claim 1, wherein the sidewall of the feeder sleeve is cylindrical and has a generally circular cross-section.

4. The feeder system of claim 1, wherein the second end of the feeder sleeve defines an open bore therethrough.

5. The feeder system of claim 1, wherein the protrusions are integrally formed with the sidewall.

6. The feeder system of claim 1, wherein the protrusions extend from the second end towards the first end along 4-25% of the maximum height of the feeder sleeve, as measured in the direction of the longitudinal axis.

7. The feeder system of claim 1, wherein the plurality of protrusions comprises at least 3, 4, 5, 6, 7, 8, 9, or 10 discrete protrusions.

8. The feeder system of claim 1, wherein each protrusion extends around 3-25% of the circumference of the sidewall at the second end of the feeder sleeve.

9. The feeder system of claim 1, wherein the distance between the centres of adjacent protrusions is 5-50% of the circumference of the sidewall at the second end of the feeder sleeve.

10. The feeder system of claim 1, wherein the at least one protrusion has a cross-section which is semi-circular, quarter-circular, wedge-shaped, or square.

11. The feeder system of claim 1, wherein the protrusions are arranged in a scalloped configuration around the periphery of the second end of the feeder sleeve.

12. A feeder sleeve for use in the feeder system of claim 1, the feeder sleeve comprising a first end and an opposite second end, a longitudinal axis extending between the first and second ends, and a continuous sidewall extending generally around the longitudinal axis between the first and second ends, the sidewall defining a cavity for receiving molten metal during casting, the first end of the feeder sleeve being configured for mounting on a breaker core, and the feeder sleeve comprising a plurality of discrete protrusions extending perpendicularly to the longitudinal axis from an exterior surface of the sidewall at the second end of the feeder sleeve, and wherein the protrusions extend outwardly from the sidewall to a distance of 5-35% of the maximum diameter of the sidewall at the second end of the feeder sleeve, and wherein the thickness of the sidewall at the second end of the feeder sleeve is greater than the radial extension of the protrusions.

13. A feeder system for metal casting, the feeder system comprising a feeder sleeve mounted on a breaker core, the feeder sleeve having a first end and an opposite second end, a longitudinal axis extending between the first and second ends, and a continuous sidewall extending generally around the longitudinal axis between the first and second ends, the sidewall defining a cavity for receiving molten metal during casting, and the breaker core defining an open bore therethrough for connecting the cavity to the casting, wherein the first end of the feeder sleeve is mounted on the breaker core, and the feeder sleeve comprises a plurality of discrete protrusions extending from an exterior surface of the sidewall at the second end of the feeder sleeve, and wherein the protrusions extend outwardly from the sidewall to a distance of 5-35% of the maximum diameter of the sidewall at the second end of the feeder sleeve, and wherein the protrusions extend from the second end towards the first end along 5-20% of the maximum height of the feeder sleeve, as measured in the direction of the longitudinal axis, and wherein the bottom of each protrusion is rounded, and wherein each protrusion extends around less than 15% of the circumference of the sidewall at the second end of the feeder sleeve.

* * * * *